US005337675A

United States Patent [19]

Aubermann

[11] Patent Number: 5,337,675

[45] Date of Patent: Aug. 16, 1994

[54] TRAIN FOR REPLACING A RAILROAD TRACK HAVING RETRACTABLE DRIVE MECHANISMS FOR TRAVELING ON THE CROSS-TIES WITHOUT RAILS

[75] Inventor: Tibor Aubermann, Saint-Legier, Switzerland

[73] Assignee: Matisa Materiel Industriel S.A., Crissier, Switzerland

[21] Appl. No.: 947,154

[22] Filed: Sep. 18, 1992

[30] Foreign Application Priority Data

Oct. 30, 1991 [CH] Switzerland ..... 3169/91-3

[51] Int. Cl.[5] ..... E01B 27/00

[52] U.S. Cl. ..... 104/2; 104/5; 105/215.2

[58] Field of Search ..... 104/2, 5, 9; 105/72.2, 105/215.1, 215.2

[56] References Cited

U.S. PATENT DOCUMENTS

| | | | |
|---|---|---|---|
| 1,376,648 | 5/1921 | Schneider | 105/215.2 X |
| 4,236,452 | 12/1980 | Theurer et al. | 104/2 |
| 4,643,100 | 2/1987 | Valditerra | 104/2 |
| 4,773,332 | 9/1988 | Theurer et al. | 105/215.1 |
| 4,979,247 | 12/1990 | Buhler | 104/5 |
| 5,092,247 | 3/1992 | Aubermann | 104/2 |

FOREIGN PATENT DOCUMENTS

| | | |
|---|---|---|
| 0388573 | 9/1990 | European Pat. Off. . |
| 2419998 | 4/1978 | France . |
| 657649 | 9/1986 | Switzerland . |

*Primary Examiner*—Robert J. Oberleitner
*Assistant Examiner*—S. Joseph Morano
*Attorney, Agent, or Firm*—Kane, Dalsimer, Sullivan, Kurucz, Levy, Eisele & Richard

[57] ABSTRACT

The invention comprises essentially a first car (1) resting on a bogey running on the track to be replaced, and a second bogey (3) moving during the work cycles with the aid of two auxiliary devices (5, 6) above the old cross-ties (4) without rails. It also comprises a work unit for removing the old rails, a unit (8) for the old cross-ties (4) and a unit (10) for laying new cross-ties (2). The auxiliary devices (5, 6) are two retractable translation devices arranged so as to be able to move on the cross-ties (4) without rails and are disposed on either side of the second bogey (3).

11 Claims, 6 Drawing Sheets

TRAIN FOR REPLACING A RAILROAD TRACK HAVING RETRACTABLE DRIVE MECHANISMS FOR TRAVELING ON THE CROSS-TIES WITHOUT RAILS

FIELD OF THE INVENTION

The present invention relates to a train for replacing a railroad track comprising essentially a first car resting on a bogey running on the track to be replaced, and a second bogey moving during the work cycles with the aid of auxiliary means above the old cross-ties without rails, said train comprising at least work units for removing the old rails and old cross-ties and for laying new cross-ties.

PRIOR ART

When replacing a railroad track, part of the train runs on the old track whereas another part, depending on the configuration of the train, has to run on the old cross-ties without rails, or directly on the roadbed, or on the new cross-ties, or possibly on the new rails if the train is designed for the laying of new rails to be performed during a single pass.

Depending on the situations encountered, different solutions have been proposed consisting in providing the part of the train, which is located above the partially stripped part of the track, with means making it possible to move, either directly on the roadbed, or on the old cross-ties without rails, possibly on the new cross-ties.

These means may be either detachable or retractable, such as a device with caterpillar tracks adapted to be able to move directly on the ballast or on the cross-ties.

Patent Application FR-A-2,419,998 describes a train for replacing railroad tracks comprising two cars articulated to one another and supporting the various work units for removing the old track and for laying the new one, as well as several cars for storing new and old cross-ties. The first car runs on the old track, whereas the second one runs on the new track. The bogey of the car located above the work zone, where the track is partially dismantled, is fitted with a translation device which moves by sliding or running in the counter-sinks of the old cross-ties without rails, the other bogey of this car running on the old track. This manner of proceding, namely having a translation device on which the bogey of the car is mounted has some advantages, particularly concerning the geometry of the train to which the measurement base for the laying of the replacement track is directly linked.

In fact in other track replacement trains, the retractable device moving, either on the roadbed, or on the cross-ties, is not mounted directly under the bogey of the car, but in front or behind, which changes the geometry of the train and of the measurement base, a situation which is particularly awkward around curves.

Despite the fact that the use of the translation device under the bogeys offers some advantages, its bringing into and out of operation requires a certain amount of time during which the replacement work is not being carried out. Furthermore, when the replacement of a railroad track is undertaken and when the end of a working day is reached, it is necessary to leave the join of the old and of the new track in good condition, because the track must be able to be used outside the working hours by passenger or freight trains. This requirement has the consequence that both at the start of the work and at the end of the work the various operations for removing the old rails and the old cross-ties, the leveling of the ballast, the laying of new cross-ties and possibly the laying of rails must be able to be interrupted or brought into operation progressively as the train moves over the join of the old track and of the replacement track. With the use of the abovementioned translation device, when the track replacement train arrives in the zone where the work is to begin, it is necessary firstly to set aside the old rails, to bring, by mechanical or manual means, the translation device onto the stripped part, to cause the train to advance so that the bogey rides on the translation device, to secure it and then to begin, progressively as the train advances, to implement the various operations of stripping and of re-equipping the track.

SUMMARY OF THE INVENTION

The purpose of the present invention is to provide a railroad track replacement train making it possible to remedy the abovementioned disadvantages and, in particular, to save time while profiting from the advantages of using the translation device in the work zone and to limit, or even eliminate, the manual work in this zone.

The track replacement train according to the present invention is defined in that said auxiliary means consist of at least two retractable translation devices arranged so as to be able to move on the cross-ties without rails, said devices being disposed on either side of the second bogey in the longitudinal direction of the track and articulated to the car about axes parallel to the axis of articulation of the bogey to the car.

The advantages of this track replacement train are as follows:

1) There is no need to undertake a special handling operation in order to put a translation device in place under the bogeys since these devices form part of the track replacement train and can be brought into service solely by an appropriate con, hand. Therefore there is no time lost in putting the translation devices into place.

2) Safety is increased by the fact that the translation devices are put into place without workers operating directly under the car.

According to a preferred variant embodiment, the translation devices are articulated to the car by axes of articulation symmetrical to the axis of articulation of the bogey, or even the same axis, which makes it possible, despite the use of translation devices located before and after the bogey, to maintain the geometry of the train and the measurement base.

According to another variant embodiment, each translation device is suspended from said chassis by two pairs of jacks, the jacks of each pair being parallel to each another and serving on the one hand, to put into place or to retract the translation device, and on the other hand to guide said device particularly around the curves of the track to be replaced.

According to one variant embodiment, the track replacement train may either be a train for removing the old rails and cross-ties and laying new cross-ties, the laying of new rails being performed during a subsequent operation, or be a complete train which also undertakes the laying of new rails.

According to one variant embodiment, the train also comprises a leveling device for flattening and clearing the ballast, which operation becomes all the more necessary since wooden cross-ties are replaced by concrete cross-ties the height of which is greater than that of the wooden cross-ties and it is then necessary to reduce the thickness of the layer of ballast before laying new cross-ties of concrete.

The work of flattening and clearing the ballast is usually done by means of a plow which may have various shapes. The Applicant Company often uses a plow having a triangular shape, for example that described in EP-A-0,059,800. Although this type of plow is entirely satisfactory, at the start of the replacement work and at the end, part of the ballast must be handled manually. In fact, the plow has a certain length and in order for it to be brought into operation it is necessary to remove the rails and the cross-ties over a length at least equal to the length of the plow and also to handle the ballast manually before bringing the plow into operation. A similar problem arises when the work is stopped, since a heap of ballast remains in front of the plow which is cleared manually. These problems when bringing the leveling unit into and out of operation are only partially diminished or not diminished at all by the use of two movement devices, as this is a problem in addition to that of moving the second bogey above the work zone.

The present invention proposes a palliative to this problem.

The train according to the invention is provided with a leveling unit comprising a plow and an auxiliary device for clearing the ballast disposed in front of the plow, the plow and said auxiliary device being capable of being brought into and out of operation independently of one another.

This auxiliary device may be quite simply a blade perpendicular to the plane of the track and its axis which is lowered in order to push the ballast over a length sufficient to allow the plow to be put into place. Similarly, when the end of the work is reached, the auxiliary device serves to push onto a transverse line the heap of ballast which is subsequently removed manually, the manual work relating in this case only to a narrow zone.

Although this solution is advantageous in respect of its simplicity, nevertheless, it still does not make it possible to push the ballast down to the required depth in a single pass and the ballast is not removed onto the sides of the track, which necessitates a manual operation.

To remedy this, the invention provides, according to another preferred variant, for the auxiliary device to be a dynamic device, such as a "cutter" formed by an endless belt or chain driven in rotation about an axis parallel to the axis of the track, and the outer surface of which is provided with members serving to push the ballast laterally. Preferably, the device comprises two cutters disposed side by side in the direction of the width of the track and pushing the ballast from the axis of the track toward the lateral sides. This device makes it possible, without any manual operation, to bring the plow into and out of operation at the start and at the end of the work, thus contributing, on the one hand, to the leveling unit being brought rapidly into or out of operation and, on the other hand, to improving the safety conditions, given that direct human operation in order to start or to finish the work is not necessary.

According to a preferred embodiment, the two cutters are mounted on devices serving to move them angularly about an axis perpendicular to the track and thus the two cutters can come parallel to the two faces of a triangular plow which can assist when the quantity of ballast to be expelled is large.

According to a variant embodiment, the various work units are designed so as to be controlled independently of one another so that, when bringing the train into operation, the various units can be lowered successivly and progressively as the train advances; in the same manner that when work stops it is possible to stop the various units progressively. This variant makes it possible either to start at the join of the old and of the new track or, at the end of the working day, to create the new join between the old and the new track without having to proceed with complex operations, requiring a great loss of time as is the case when units are used which have to be brought into or out of operation simultaneously. Direct human operation is thus limited, which also contributes to safety.

BRIEF DESCRIPTION OF THE DRAWINGS

The invention will be described in greater detail with the aid of the accompanying drawing.

Figure 1:
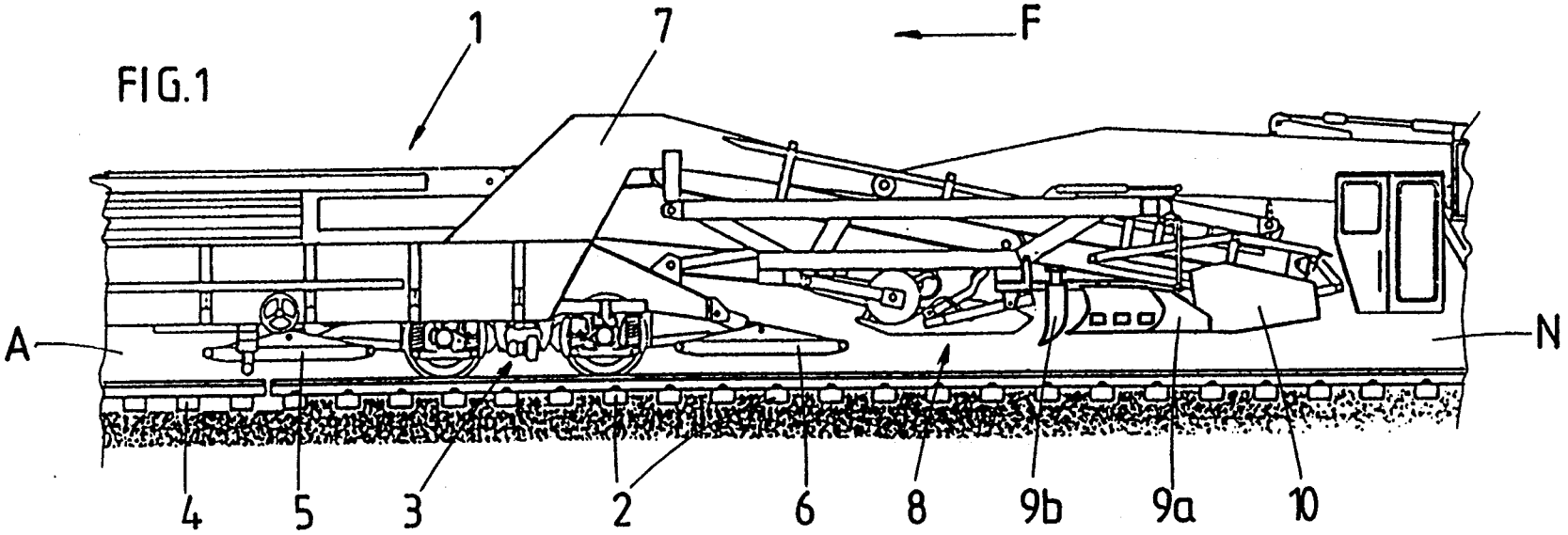
FIGS. 1 through 5 give a diagrammatic side view of the second bogey of the car with the translation devices and part of the work units in different positions during the bringing into or out of operation.
Figure 2:
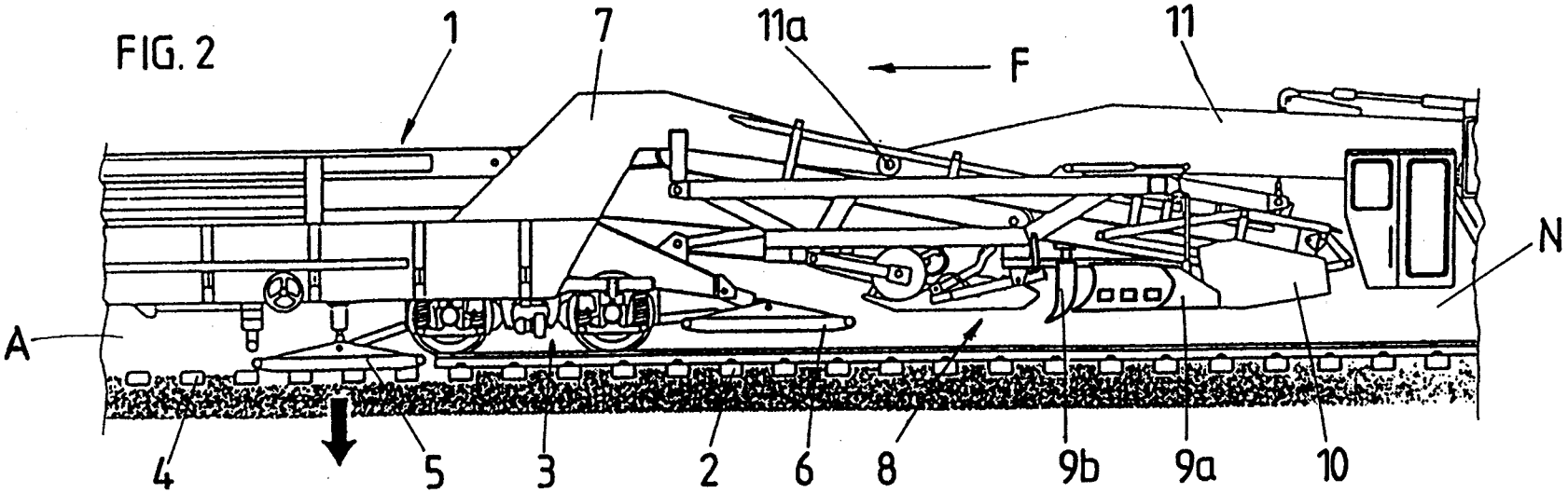
Figure 3:
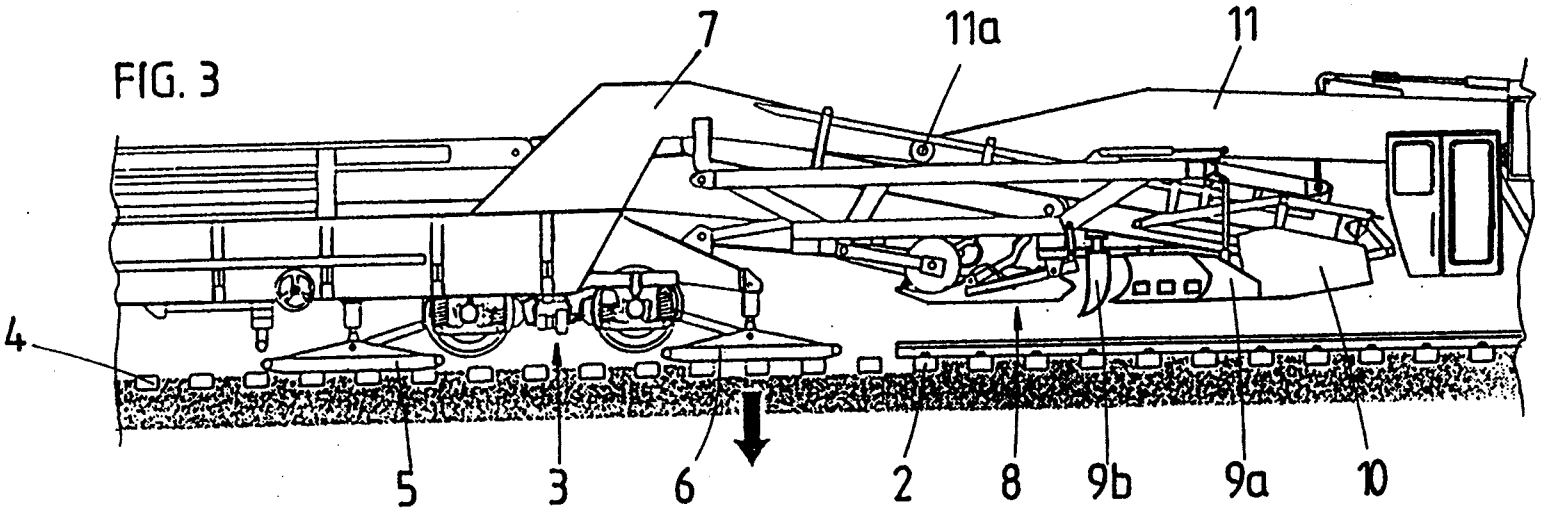
Figure 4:
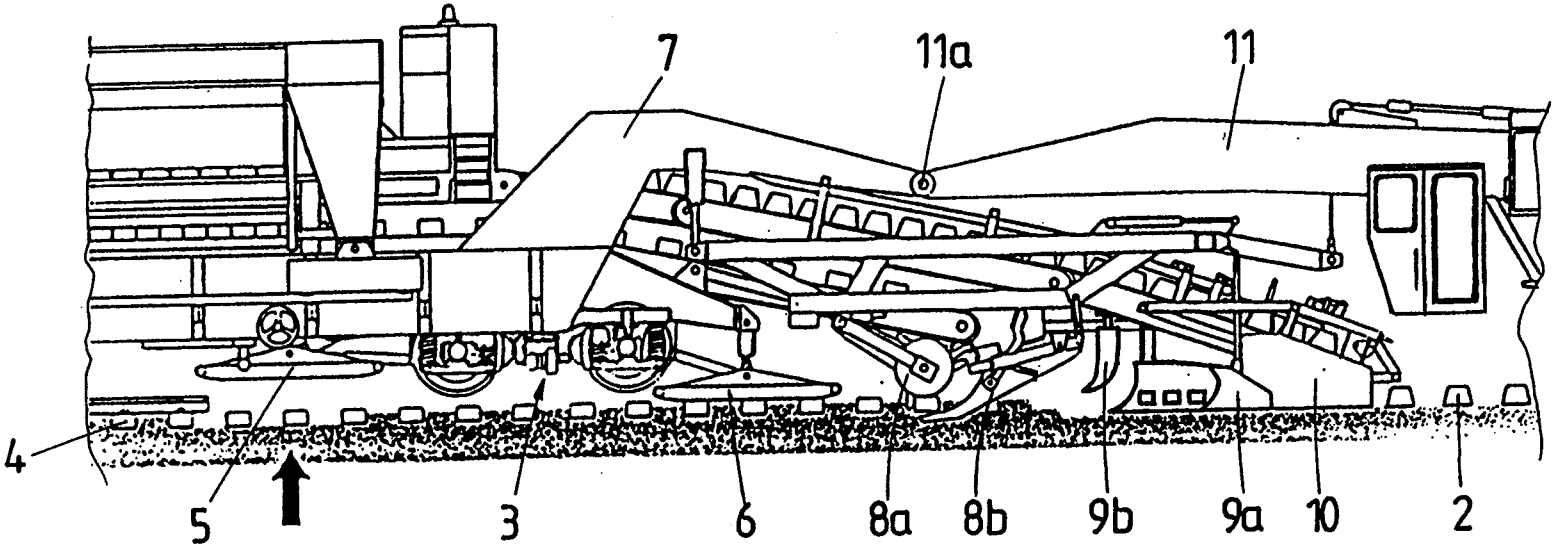
Figure 5:
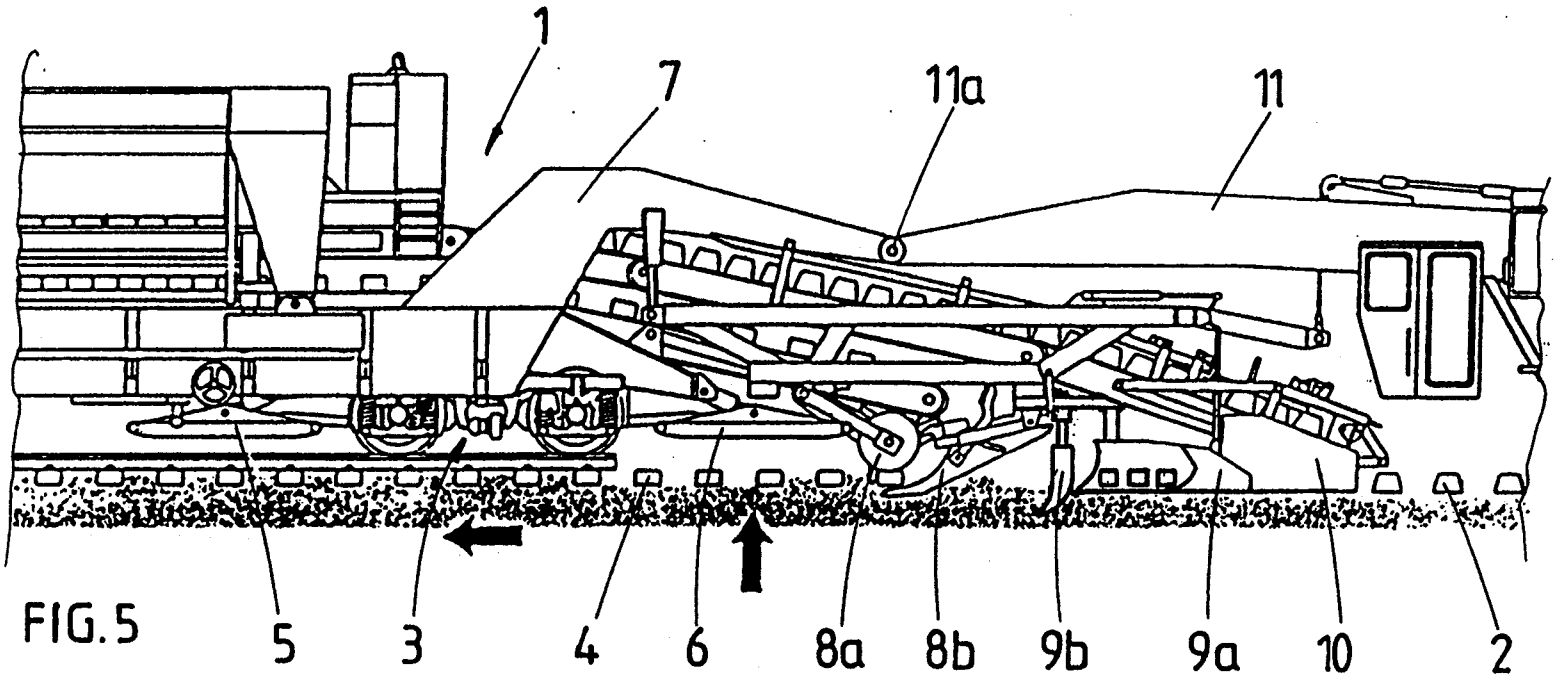

A complete track replacement train is not shown in the figures but only the parts which form the subject of the present invention. By way of example, a complete track replacement train is shown in Patent Application FR-A-2,419,998.

DESCRIPTION OF THE PREFERRED EMBODIMENTS

FIGS. 1 through 5 show the posterior part of a car 1 fitted with two bogeys the first of which (not shown) runs on the new track N resting on new cross-ties 2 whereas the second bogey 3 runs on the track to be replaced A resting on old cross-ties 4. Two translation devices 5 and 6 are suspended in front of and behind the bogey 3 so as to permit movement of the car 1 when the bogey 3 is located above the zone which is stripped of rails. The movement during the work is made in the direction F. Various work units are suspended by a beam 7 behind the bogey 3: a first unit 8 relating to the removal of the old cross-ties, a leveling unit comprising a plow *9a* and an auxiliary device *9b*, a unit 10 for laying new cross-ties. For information, it should be stated that a second car 11 running on new track or is articulated to the first by an articulation *11a* and supports the device for putting new rails into place whereas the part anterior to the bogey 3 of the car 1 supports the means for removing the old rails.

The train as described here is in its complete configuration; nevertheless, the translation devices 5 and 6 may very well be used with a train whose configuration is less complete, for example without the installation for laying new rails; the latter will be laid during a pass of another machine and in this case, of course, the second car 11 will not be coupled to the car 1. It is also possible to have a train comprising only the car 1 which is not, for example, fitted with a leveling unit *9a, 9b* and for the train to undertake solely the removal of the old cross-ties 4 as well as the laying of new cross-ties 2 when the leveling is not necessary. Of course, the complete configuration of the train is that which has the greatest number of advantages.

Figure 6:
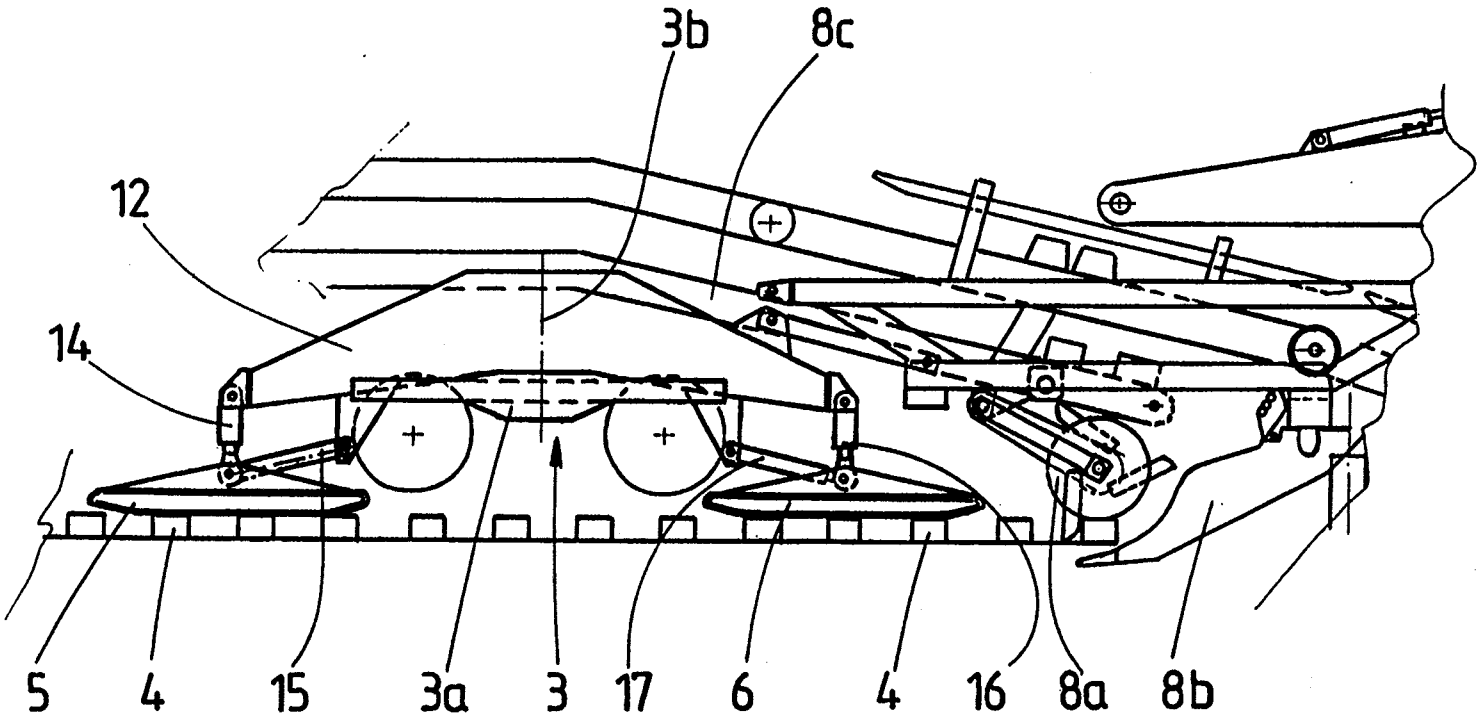
FIG. 6 is a partial side view of the second bogey with the two translation devices in the working position and part of the work units.

Before continuing with the description and setting out the use of two translation devices 5 and 6, the new members which form part of this train will be described in detail. Reference will now be made to FIG. 6 showing the two translation devices in greater detail.

This partial side view of the train around the second bogey of the car 1 shows the device for removing the old cross-ties comprising a cylinder 8*a* which in combination with a lever 8*b* and a transfer device 8*c* carries out the removal and clearance of the old crossties. The bogey 3 and its chassis 3*a* are articulated about an axis 3*b*. Another chassis 12 which in the present case is articulated about the see axis 3*b*, supports at the two ends, on either side of the bogey, two translation devices 5 and 6. These translation devices are devices with rollers, with caterpillar tracks or with skids, resting on the cross-ties and more precisely on the old cross-ties 4 without rails and more precisely in the countersinks of the cross-ties 4. Each translation device is in reality composed of two translation devices which may be independent and are spaced laterally apart by the same distance as the gage of the rails. Each of these devices is suspended from the chassis 12 by two jacks 14, 15 and 16, 17 serving to put these devices into place or to bring these devices into operation as well as to provide some guiding particularly between the left and right apparatus by acting in particular on the jacks 15 and 17 respectively. It is a matter here, of a simple variant embodiment, relating to the manner of suspending the translation device from a chassis 12 and other possibilities can be envisaged while remaining within the scope of the present invention.

By way of example, it can be conceived that each translation device 5 and 6 is articulated directly to the car 1 by an axis of articulation which is independent of the axis 3*b* of the bogey.

Each of these translation devices 5 and 6 is brought into and out of operation independently of each other as will be explained later.

According to two variant embodiments, the devices 5 and 6 can possibly be articulated directly on the chassis 3*a* of the bogey 3 or to extensions of this chassis while still remaining within the spirit of the present invention.

The translation devices 5 and 6 may appear in any known form, for example that described in document EP-A-0,060,590.

Figure 7:
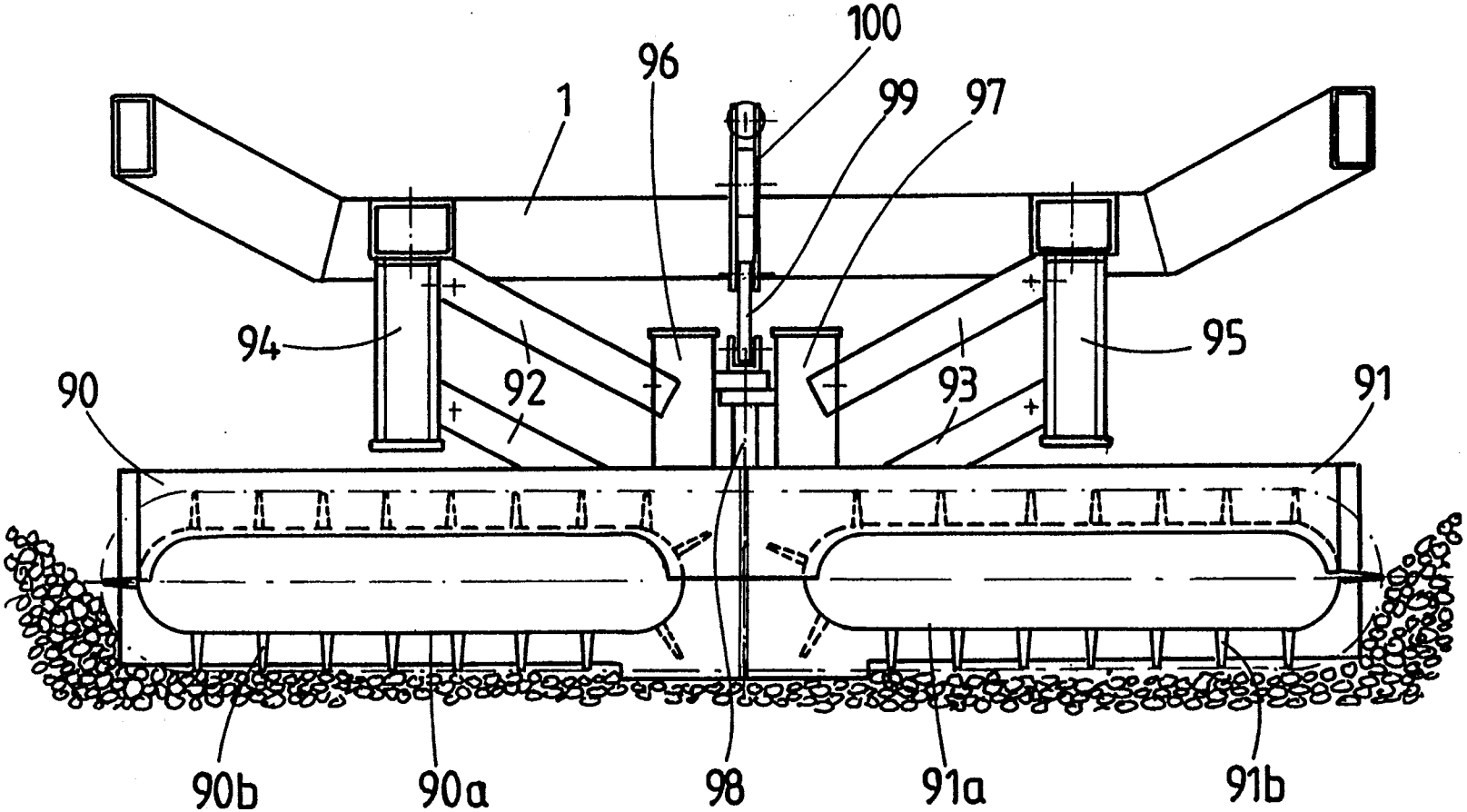
FIG. 7 is a front view of the auxiliary leveling device.
Figure 8:
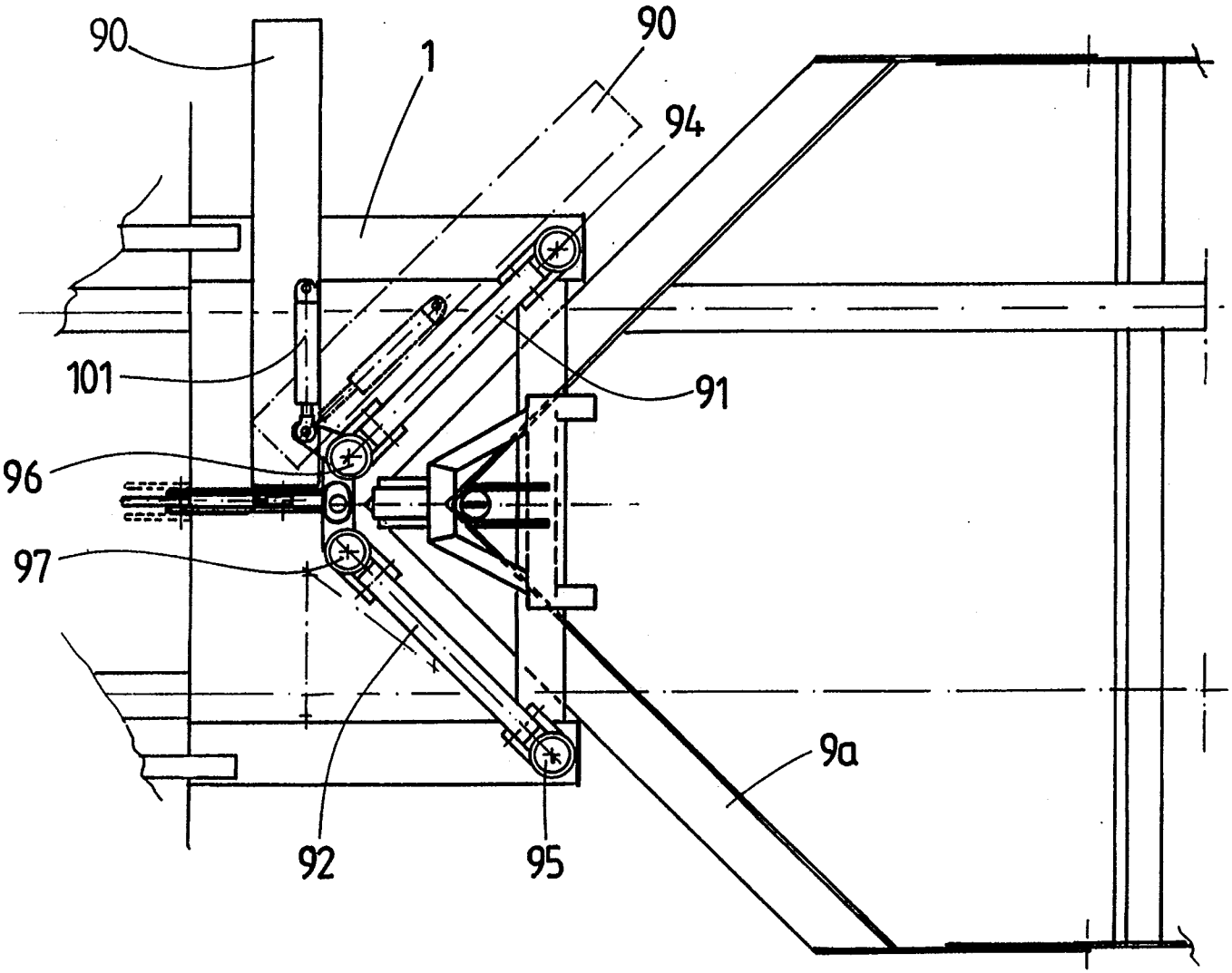
FIG. 8 is a plan view of the leveling unit.

FIGS. 7 and 8 show the leveling device to a larger scale than the preceding drawings and more particularly the auxiliary device for clearing the ballast. The leveling device thus comprises a triangular plow 9*a* and an auxiliary device 9*b*. We shall not dwell on the description of the plow 9*a* which in this case is triangular and corresponds to that described in EP-A-0,059,800.

The auxiliary device 9*b* consists of two chassis 90, 91 suspended from the chassis of the car 1 by a pair of arms 92, 93 respectively, articulated on the one hand about a pin 94, 95 respectively, which is integral with the chassis of the car I and, on the other hand, about a pin 96, 97 respectively, which is integral with the chassis 90, 91 respectively. The two pins 96, 97 which are integral with the chassis 90 and 91 are articulated about a hinge-forming pin 98 and the assembly is guided perpendicularly to the plane of the track by a pin 99 located in the extension of the pin 98, sliding inside a guide tube 100 which is integral with the chassis of the car 1.

Each chassis 90 comprises an endless belt or chain 90*a*, 91*a* respectively fitted with means so as to be driven in rotation about an axis parallel to the plane of the track and each belt or chain is fitted with blades 90*b*, 91*b* respectively designed to push the ballast. The two belts or chains 90*a*, 91*a* are driven in rotation so that the ballast is pushed from the inside toward the outside of the track. One piston 101 (FIG. 8) per auxiliary device serves to modify the slant of the device about an axis perpendicular to the track. Thus, the two auxiliary devices can either be placed parallel to the faces forming the triangle of the plow 9*a*, or be aligned in a same plane perpendicular to the axis of the track. In the first position the auxiliary device serves possibly to assist the plow in its work if a large quantity of ballast has to be cleared, whereas the second position is especially useful when the leveling is to be terminated at the join of the old track and of the new track. In FIG. 8, the device 90 is shown in dot-and-dash lines in the slanting position and in solid lines in the deployed position.

With the aid of FIGS. 1 through 5, the beginning and the conclusion of the replacement work will now be briefly described.

FIG. 1 shows the train and in particular the second bogey 3 of the car 1 located in proximity to the join of the old track A and of the new track N. Starting from this position, the device for setting aside the old rails supported by the car 1 (not shown here) proceeds to set aside the old rails and when the first cross-ties 4 of the old section are disengaged, the first of the translation devices 5 is put into place (FIG. 2), which enables the train to advance by sliding the device 5 in the countersinks of the cross-ties of the old track. Once the train has advanced sufficiently, the second translation device 6 is also put into place and thus the weight supported before by the second bogey is now supported by both translation devices making it possible, on the one hand, to maintain the geometry of the train and, on the other hand, to distribute the weight over two devices, which reduces the pressure exerted on the old cross-ties. Progressively as the train advances, the various devices are brought into operation, namely, in order, the device 8 for removing the old cross-ties, afterwards the auxiliary device 9*b* for clearing the ballast (both auxiliary devices being in a plane perpendicular to the axis of the track) and when the train is far enough forward and when there is sufficient room on the roadbed to put the plow 9*a* into place, the latter is put into place and lastly the device 10 for laying the new cross-ties 2 is in place and possibly the installation for fitting the new rails is brought into operation, if the train is equipped therewith.

Therefore, by using the two translation devices, the work at the join of the old and of the new track is started without the need for human operation under the machines and automatically with the minimum loss of time.

At the end of the work, the work is performed in reverse manner, namely, when it is decided to stop the work (FIG. 4), initially the first translation device 5 is retracted while continuing the work of removal and laying. While the bogey 3 rests on the old track, the second device is retracted, while the various units continue to work and they are taken out of operation in the same order as they are brought into operation, namely, the device 8 for removing the old cross-ties is taken out of operation first, then if the auxiliary device 9*b* was not in operation during the work it is brought into operation or if it was in operation, at the moment when the plow 9*a* is taken out of operation, the auxiliary device 9*b* can continue to clear the ballast up to the level of the old track, the device 10 for putting the new cross-ties into place is also taken out of operation when the join of the old and of the new track is reached.

When the work is stopped, the taking out of operation is performed very rapidly without direct human operation under the machines; thus the track can rapidly be made available to traffic. This flexibility of use and rapidity when starting and finishing the replacement work, particularly in the region of the join, are obtained, on the one hand, by virtue of the two auxiliary translation devices and, on the other hand, and in particular for the complete configuration of the train, by virtue of the auxiliary device for clearing the ballast which makes it possible to avoid any human operation for clearing the ballast in the region of the join of the old track and of the new track and the fact that the various work units can be brought into or out of operation independently of one another.

As already mentioned previously the auxiliary device for clearing the ballast may be a simple blade but its efficiency particularly in clearing a deep layer of ballast, is restricted.

I claim:

1. A train for replacing a railroad track having a plane and axis comprising a first car resting on a bogey running on the track to be replaced, and a second bogey having an axis of articulation and moving with the aid of auxiliary means above a old cross-ties without rails, said train comprising at least work units for removing the old cross-ties and laying new cross-ties, wherein said auxiliary means is comprised of at least two retractable translation devices that are securely attached to an independent chassis articulated to the car by the same axis of articulation as the second bogey and arranged so as to be able to move on the cross-ties without rails, said devices being disposed on either side of the second bogey in the longitudinal direction of the track and articulated to the car about axes parallel to the axis of articulation of the second bogey to the car.

2. The train as claimed in claim 1, wherein the axes of articulation of the devices to the car are disposed symmetrically with respect to the axis of articulation of the second bogey to the car.

3. The train as claimed in claim 1, wherein each translation device is suspended by means allowing it to turn about an axis perpendicular to the axis of the track so as to facilitate its guiding around curves.

4. The train as claimed in claim 1, wherein each translation device is suspended from the chassis by two pairs of jacks, the jacks of each pair being parallel and disposed so as to allow the translation devices to be put into place for movement on the old cross-ties without rails, to be retracted for light running, and to be guided around the curves of the track.

5. The train as claimed in claim 4, wherein the various work units are equipped so as to be brought into or out of operation independently of one another.

6. A device as claimed in claim 5, wherein said train also comprises a retractable unit for leveling the ballast which unit is disposed between the unit for removing the old cross-ties and that for laying the new cross-ties.

7. The train as claimed in claim 6, wherein the unit for leveling the ballast comprises a plow and an auxiliary device for clearing the ballast disposed in front of the plow in the direction of movement of the train, the plow and the auxiliary device being brought into or out of operation independently of one another.

8. The train as claimed in claim 7, wherein said auxiliary device is a dynamic device fitted with means for moving the ballast toward at least one of the lateral sides of the track.

9. The train as claimed in claim 8, wherein said dynamic device comprises at least one endless transmission member driven in rotation about an axis at least approximately parallel to the plane of the track and provided on its outer surface with members for pushing the ballast toward at least one of the sides of the track.

10. The train as claimed in claim 8, wherein said dynamic device comprises two endless transmission members disposed side by side in the direction of the width of the track, driven in rotation about axes parallel to the plane of the track, said members being provided on their outer surface with members for pushing the ballast onto the sides of the track.

11. The train as claimed in claim 10, wherein said transmission members are supported by devices arranged so as to be able to move said transmission members angularly about an axis perpendicular to the plane of the track.

* * * * *